US007014487B2

(12) United States Patent
Ishikawa

(10) Patent No.: US 7,014,487 B2
(45) Date of Patent: Mar. 21, 2006

(54) CONNECTOR CAPABLE OF PREVENTING ABRASION

(75) Inventor: Koji Ishikawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 18 days.

(21) Appl. No.: 10/979,247

(22) Filed: Nov. 3, 2004

(65) Prior Publication Data

US 2006/0009063 A1 Jan. 12, 2006

(30) Foreign Application Priority Data

Jul. 8, 2004 (JP) ..... 2004-201723

(51) Int. Cl.
*H01R 11/22* (2006.01)

(52) U.S. Cl. ..... 439/267

(58) Field of Classification Search ..... 439/155, 439/160, 260, 267, 629–635
See application file for complete search history.

(56) References Cited

U.S. PATENT DOCUMENTS 3,478,700 A * 11/1969 McIver et al. ..... 439/635
3,553,630 A * 1/1971 Scheingold et al. ..... 439/267
3,601,770 A * 8/1971 Bowley ..... 438/563
3,665,370 A * 5/1972 Hartmann ..... 439/260
3,697,929 A * 10/1972 Konewko et al. ..... 439/260
3,963,317 A * 6/1976 Eigenbrode et al. ..... 439/267
4,021,091 A * 5/1977 Anhalt et al. ..... 439/260
4,047,782 A * 9/1977 Yeager ..... 439/267
4,085,990 A * 4/1978 Jayne ..... 439/267
4,118,094 A * 10/1978 Key ..... 439/635
4,159,861 A * 7/1979 Anhalt ..... 439/267
4,189,200 A * 2/1980 Yeager et al. ..... 439/267
4,275,944 A * 6/1981 Sochor ..... 439/267
4,303,294 A * 12/1981 Hamsher et al. ..... 439/267
4,332,431 A * 6/1982 Bobb et al. ..... 439/267
4,392,700 A * 7/1983 Showman et al. ..... 439/260
4,428,635 A * 1/1984 Hamsher et al. ..... 439/265
4,468,073 A * 8/1984 Machcinski ..... 439/266
4,477,133 A * 10/1984 Cosmo ..... 439/62
4,478,471 A * 10/1984 Olsson ..... 439/267
4,540,228 A * 9/1985 Steele ..... 439/267
4,553,803 A * 11/1985 Lapraik et al. ..... 439/260
4,575,171 A * 3/1986 Igarashi et al. ..... 439/267
4,588,912 A * 5/1986 Shinmura et al. ..... 310/68 R (Continued)

FOREIGN PATENT DOCUMENTS

JP 54-98986 8/1979
JP 10-22005 1/1998

*Primary Examiner*—P. Austin Bradley
*Assistant Examiner*—Larisa Tsukerman
(74) *Attorney, Agent, or Firm*—Armstrong, Kratz, Quintos, Hanson & Brooks, LLP

(57) ABSTRACT

A slider is incorporated in a connector. A guide is designed to guide movement of the slider along a predetermined plane. An elastic terminal or contact extends to the free tip end from the stationary end. An inclined surface is defined on the slider so as to receive the elastic terminal. The inclined surface extends along an imaginary plane intersecting an imaginary reference plane including the predetermined plane by a predetermined inclination angle. The movement of the slider enables displacement of the contact position between the inclined surface and the elastic terminal in the connector. The inclined surface generates a driving force directed to the elastic terminal in response to the movement of the slider. The elastic terminal is thus caused to deform. This deformation can be utilized to control the contact between the elastic terminal and a connective member to be connected.

6 Claims, 4 Drawing Sheets

U.S. PATENT DOCUMENTS 4,606,594 A * 8/1986 Grabbe et al. ..... 439/267
4,643,500 A * 2/1987 Krumme ..... 439/161
4,695,111 A * 9/1987 Grabbe et al. ..... 439/266
4,722,700 A * 2/1988 Kuhn et al. ..... 439/629
4,840,575 A * 6/1989 Matsuoka ..... 439/267
6,004,151 A * 12/1999 Hashiguchi ..... 439/260
6,618,942 B1 * 9/2003 Beaman et al. ..... 29/854
6,644,995 B1 * 11/2003 Jones et al. ..... 439/260

* cited by examiner

CONNECTOR CAPABLE OF PREVENTING ABRASION

BACKGROUND OF THE INVENTION

1. Field of the Invention

The present invention relates to a connector designed establish connection between at least a pair of electrical conductor. In particular, the present invention relates to a connector designed to receive a printed circuit board such as a co-called card edge printed circuit board.

2. Description of the Related Art

Some connectors are well known to receive a so-called card edge printed circuit board. Pairs of elastic terminals or contacts are fixed within a housing of the connector, for example. The individual contacts extend from the stationary end, fixed to the housing, to the free tip end. When the card edge printed circuit board is inserted into the housing of the connector, the card edge printed circuit board is held between the contacts of the individual pairs. The card edge printed circuit board is thus stationarily coupled to the connector.

The individual contacts are strongly urged against the surface of the card edge printed circuit board. Frequent insertion and withdrawal of the card edge printed circuit board induces abrasion of the resin material in the card edge printed circuit board. The abrasion generates dusts. If the dusts enter a space between the contacts and electrically conductive pads on the card edge printed circuit board, electric connection is hindered therebetween.

For example, one solution is to avoid contact between the electrically conductive pads and the contacts during the insertion and withdrawal of the card edge printed circuit board, as disclosed in Japanese Patent Application Publication No. 54-98986. A sliding member is fixed to the free end of the contact in the disclosed connector. Sliding movement of the sliding member induces the contacts to get spaced from the electrically conductive pads of the card edge printed circuit board. However, this structure suffers from troublesome operations to couple the sliding member to the contact in the production process of the connector. The productivity thus gets deteriorated. Insertion and withdrawal of the card edge printed circuit board also suffer from troublesome operations.

SUMMARY OF THE INVENTION

It is accordingly an object of the present invention to provide a connector contributing to a facilitated production and assembling. It is an object of the present invention to provide a connector capable of reducing the urging force of an elastic terminal or contact without inducing troublesome operations.

According to a first aspect of the present invention, there is provided a connector comprising: a housing; a slider; a guide formed on the housing, said guide designed to guide movement of the slider along a predetermined plane within the housing; and an elastic terminal or contact extending to the free tip end from the stationary end fixed to the housing, wherein an inclined surface is defined on the slider so as to receive the elastic terminal, said inclined surface extending along an imaginary plane intersecting an imaginary reference plane including the predetermined plane by a predetermined inclination angle.

The movement of the slider enables displacement of the contact position between the inclined surface and the elastic terminal in the connector. The inclined surface generates a driving force directed to the elastic terminal in response to the movement of the slider. The elastic terminal is thus caused to deform. This deformation can be utilized to control the contact between the elastic terminal and a connective member inserted into the housing. The elastic terminal is simply allowed to contact the inclined surface of the slider in the production process of the connector, so that the slider can be assembled into the connector in a facilitated manner.

A receiving surface may be defined on the slider so as to receive a connective member inserted into the housing in parallel with the predetermined plane. The movement of the slider is caused in response to the insertion of the connective member in this structure. The simple insertion of the connective member induces the deformation of the elastic terminal. The contact can reliably be controlled between the connective member and the elastic terminal with conventional operations. The urging force of the elastic terminal can be adjusted without accompanying deteriorated operations.

According to a second aspect of the present invention, there is provided a connector comprising: a housing designed to receive insertion of a connective member along a predetermined imaginary reference plane; a slider assembled within the housing, said slider designed to move within the housing in parallel with the imaginary reference plane; and a receiving surface formed on the slider, said receiving surface designed to receive the insertion of the connective member.

The connector enables the movement of the slider in response to the insertion of the connective member. Conventional operations can be employed to drive the slider. A driving force acting on the slider can be converted into various forces based on the movement of the slider.

A driving force generating member may be connected to the slider. The driving force generating member may be designed to direct a driving force to the slider in a direction to move the connective member out of the housing, for example. The driving force is utilized to drive the slider to the position that is established prior to the insertion of the connective member.

A converting mechanism may be incorporated within the slider. The converting mechanism may be designed to generate a driving force along an imaginary plane intersecting the imaginary reference plane by a predetermined inclination angle, based on the movement of the slider along the imaginary reference plane. The converting mechanism allows a change in the direction of the driving force applied to the slider in a facilitated manner. The driving force may function as a driving source on various scenes.

The connector may further comprise an elastic terminal extending to the free tip end from the stationary end fixed to the housing. In this case, an inclined surface may be formed on the slider so as to receive the elastic terminal. The inclined surface extends along an imaginary plane intersecting the imaginary reference plane by a predetermined inclination angle. The movement of the slider enables displacement of the contact position between the inclined surface and the elastic terminal in the connector. The inclined surface generates a driving force directed to the elastic terminal. The elastic terminal is caused to deform. This deformation can be utilized to control the contact between the elastic terminal and the connective member.

According to a third aspect of the present invention, there is provided a connector comprising: a housing; a slider; a guide formed on the housing, said guide designed to guide movement of the slider along a predetermined plane within the housing; and a pair of elastic terminal or contact each extending to the free tip end from the stationary end fixed to the housing, said elastic terminals designed to hold a connective member therebetween, said connective member inserted into the housing in parallel with the predetermined plane, wherein a pair of inclined surfaces is defined on the slider, said inclined surfaces getting closer to each other at a location remoter from the stationary ends of the elastic terminals.

The connector allows deformation of the elastic terminal based on the contact between the inclined surface and the elastic terminal in the aforementioned manner. This deformation can be utilized to control the contact between the elastic terminal and the connective member inserted into the housing. A receiving surface may be defined on the slider so as to receive insertion of the connective member in the same manner as described above.

BRIEF DESCRIPTION OF THE DRAWINGS

The above and other objects, features and advantages of the present invention will become apparent from the following description of the preferred embodiment in conjunction with the accompanying drawings, wherein.

DETAILED DESCRIPTION OF THE PREFERRED EMBODIMENT

Figure 1:
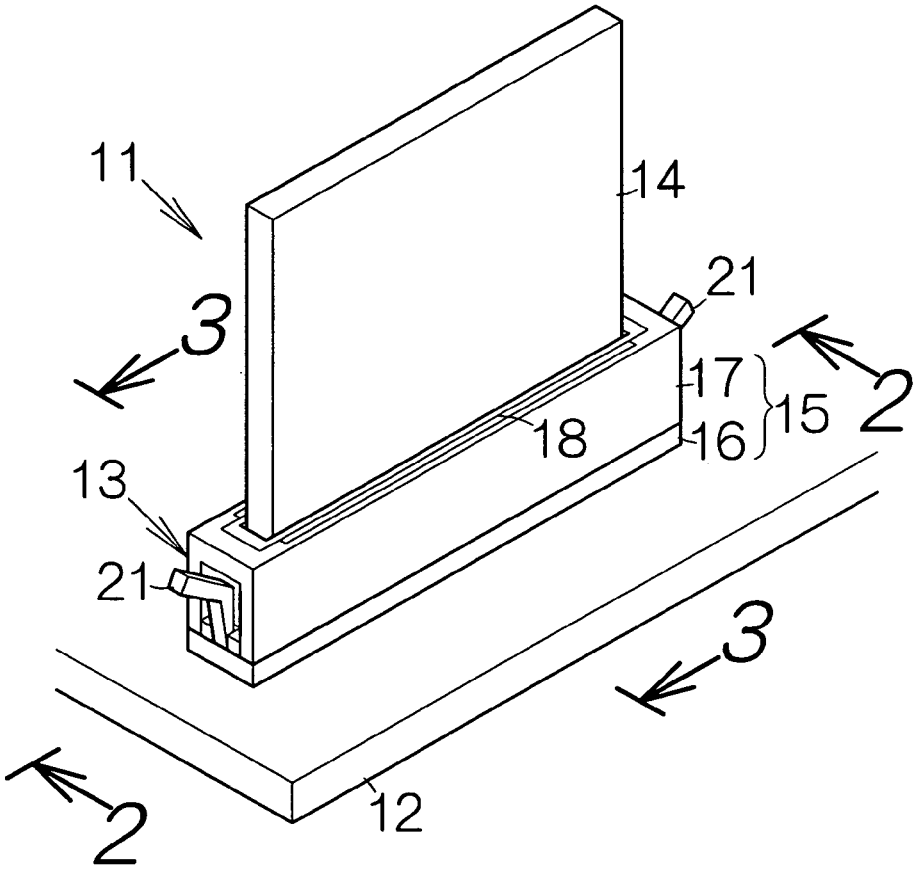
FIG. 1 is a perspective view schematically illustrating the structure of a printed circuit board unit.

FIG. 1 schematically illustrates a printed circuit board unit 11. The printed circuit board unit 11 includes a printed circuit board 12. A connector 13 is mounted on the printed circuit board 12. The connector 13 stands upright from the surface of the printed circuit board 12. A small-sized printed circuit board or so-called card edge printed circuit board 14 is inserted into the connector 13. The card edge printed circuit board 14 is kept in an attitude upright to the printed circuit board 12. The card edge printed circuit board 14 corresponds to a graphic board, a memory board, a PCI board, or other types of printed circuit board, for example. The connector 13 serves to establish electric connection between the card edge printed circuit board 14 and the printed circuit board 12 as described later in detail.

The connector 13 includes a housing 15. The housing 15 has a plate-shaped base 16 received on the surface of the printed circuit board 12. A housing body 17 is coupled to the base 16. A slider 18 is assembled within the housing body 17. The slider 18 is allowed to move upward and downward in the housing 15 in the vertical direction perpendicular to the surface of the printed circuit board 12. The card edge printed circuit board 14 is received on the slider 18. The card edge printed circuit board 14 serves as a connective member of the present invention.

A pair of lever 21, 21 is attached to the housing 15. The individual levers 21 are designed to rotate around a pair of rotation axis extending in parallel with each other. The rotation axes may be set parallel to the surface of the printed circuit board 12, for example. The levers 21 causes the slider 18 to move upward as described later in detail.

Figure 2:
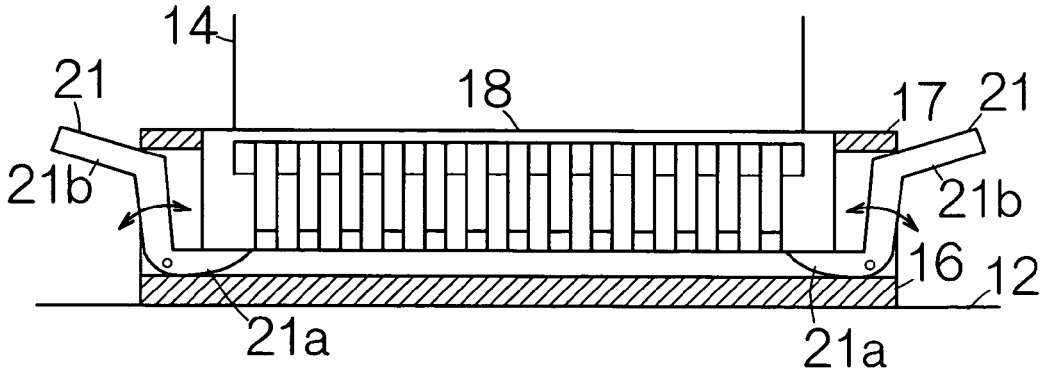
FIG. 2 is a vertical sectional view taken along the line 2—2 in FIG. 1.

As shown in FIG. 2, the lever 21 includes a driving piece 21*a* extending from the rotation axis. The driving pieces 21*a* contact the bottom surface of the slider 18. An operating piece 21*b* is connected to the driving piece 21*a*. The tip end of the operating piece 21*b* extends outward from the slider 18 in the horizontal direction. When the operating piece 21*b* is forced to move outward from the slider 18 around the rotation axis, the driving piece 21*a* rotates around the rotation axis. The driving piece 21*a* drives the slider 18 upward. The slider 18 thus moves from the lowermost position to the uppermost position. The levers 21 in this manner direct a driving force to the slider 18 in a direction to move the card edge printed circuit board 14 out of the housing 15. To the contrary, when the slider 18 is forced to move downward from the uppermost position to the lowermost position, the driving pieces 21*a* of the levers 21 move downward around the rotation axes. The levers 21 thus serve as a driving force generating member of the present invention.

Figure 3:
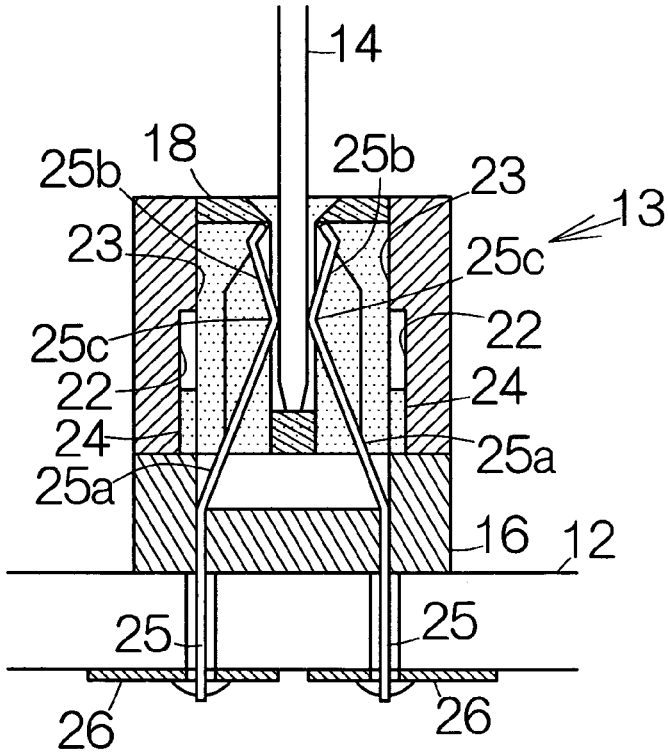
FIG. 3 is a vertical sectional view taken along the line 3—3 in FIG. 1.

As shown in FIG. 3, a pair of guide surface 22, 22 is defined on the housing body 17. The guide surfaces 22, 22 are opposed to each other. The guide surface 22 is a flat surface extending in the vertical direction perpendicular to the surface of the printed circuit board 12. The base 16 of the housing 15 serves to define the lower end of the guide surface 22. Restriction pieces 23 protruding from the respective guide surfaces 22 serve to define the upper ends of the guide surfaces 22.

The slider 18 is positioned in a space between the guide surfaces 22. A pair of guide piece 24, 24 is formed on the slider 18. The guide pieces 24 are designed to protrude outward. The individual guide pieces 24 contact the corresponding guide surfaces 22, respectively. The guide surfaces 22 thus serve to guide the vertical movement of the slider 18. When the guide pieces 24 are received on the upper surface of the base 16, the slider 18 is positioned at the lowermost position. When the guide pieces 24 contact the restriction pieces 23, the slider 18 is positioned at the uppermost position.

The stationary ends of elastic terminals or contacts 25 are fixed to the base 16 of the housing 15. The stationary ends of the elastic contacts 25 penetrate outward through the base 16. When the base 16 is received on the surface of the printed circuit board 12, for example, the stationary ends of the elastic contacts 25 penetrate through the printed circuit board 12. Electrically conductive pads 26 are arranged on the back surface of the printed circuit board 12. The stationary ends of the elastic contacts 25 are soldered to the corresponding electrically conductive pads 26, for example. The elastic contacts 25 may be made from an electrically conductive metallic plate, for example.

The elastic contacts 25 are designed to stand upright from the surface of the base 16 within the housing 15. The elastic contact 25 extends from the stationary end to the free tip end. First plate pieces 25*a* are defined in the elastic contacts 25. The first plate pieces 25*a* are designed to stand from the surface of the base 16. The first plate pieces 25*a* of the pair of the opposed elastic contacts 25 get closer to each other at a higher position. Second plate pieces 25*b* are connected to the tip ends of the first plate pieces 25*a*. The second plate pieces 25*b* of the pair of the opposed elastic contacts 25 get remoter from each other at a position closer to the free tip ends. A bent section 25*c* is defined between the first and second plate pieces 25*a*, 25*b*. The elastic contacts 25 of the pair are located closest at the bent sections 25*c*. The card edge printed circuit board 14 is interposed between the opposed bent sections 25*c*. The first plate pieces 25*a* serve to apply a sufficient urging force to the bent sections 25*c*. The pairs of the elastic contacts 25 in this manner rigidly hold the card edge printed circuit board 14 within the housing 15. The card edge printed circuit board 14 is reliably prevented from slippage.

Figure 4:
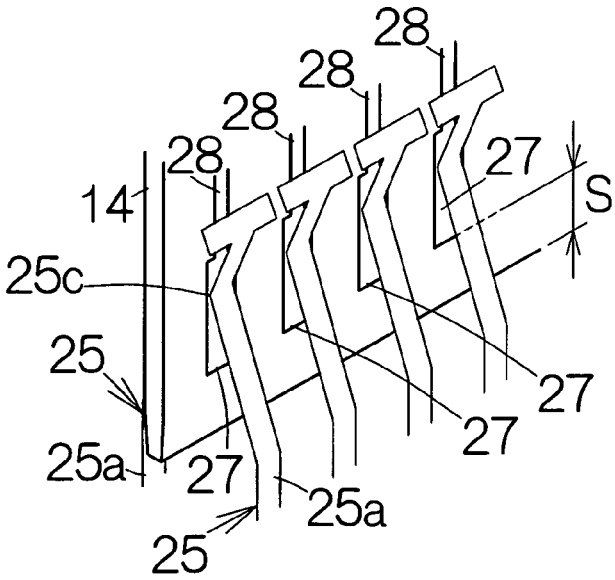
FIG. 4 is an enlarged partial perspective view schematically illustrating the structure of a card edge printed circuit board.

As is apparent from FIG. 4, electrically conductive contact pads 27 are arranged on the front and back surfaces of the card edge printed circuit board 14. Here, the contact pads 27 are arranged in a row along the edge of the card edge printed circuit board 14. The individual contact pads 27 are spaced from the edge of the card edge printed circuit board 14 by a predetermined distance S. Wiring patterns 28 extending on the front and back surfaces may be connected to the contact pads 27 in the card edge printed circuit board 14. Resin material of the card edge printed circuit board 14 is exposed around the contact pads 27 and the wiring patterns 28. In general, the resin material such as a glass epoxy resin is utilized to form the card edge printed circuit board 14. The bent sections 25*c* of the elastic contacts 25 are allowed to contact the corresponding contact pads 27. Electric connection is in this manner established between the contact pads 27 on the card edge printed circuit board 14 and the electrically conductive pads 26 on the printed circuit board 12.

Figure 5:
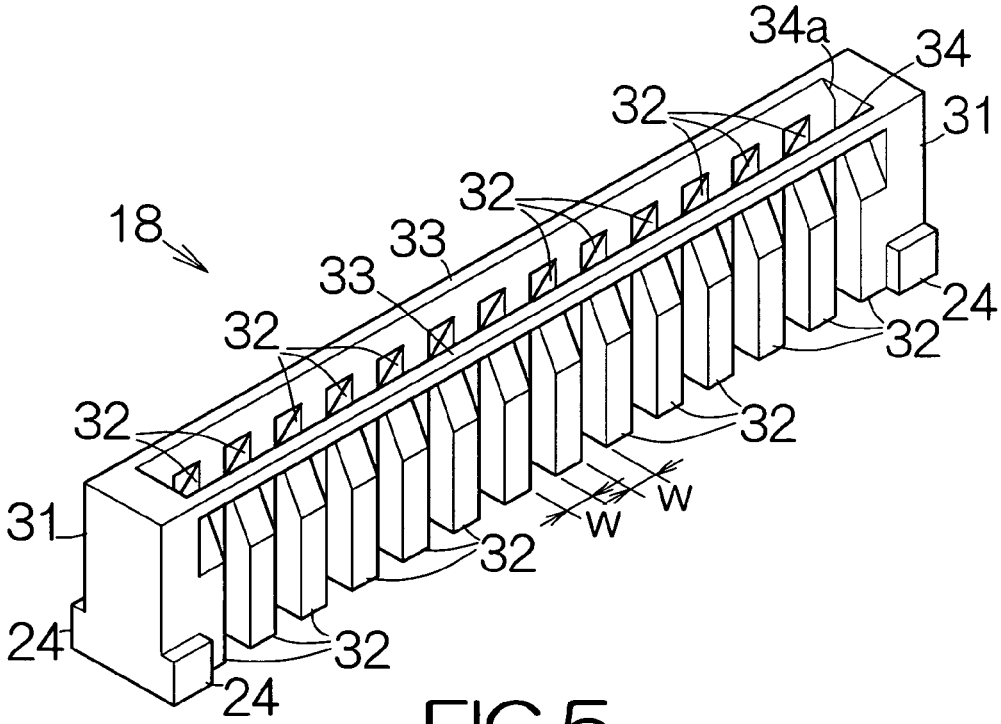
FIG. 5 is a perspective view schematically illustrating the structure of a slider.

Here, description will be made on the structure of the slider 18. As shown in FIG. 5, the slider 18 includes a pair of base block 31, 31. The base blocks 31 are spaced from each other by a predetermined distance. The guide pieces 24 are formed on the individual base blocks 31. Pairs of driving piece 32, 32, . . . are arranged between the base blocks 31, 31 in the longitudinal direction of the slider 18, for example. A passage of the card edge printed circuit board 14 is defined between the driving pieces 32, 32 of the individual pair. The driving pieces 32, 32, . . . are arranged at equal intervals W in the longitudinal direction. The elastic contact 25 is located in a space between the adjacent driving pieces 32, 32, . . . .

The base blocks 31, 31 are coupled to each other with a pair of upper connecting member 33, 33 and a lower connecting member. The lower connecting member will be described later. An insertion opening 34 is defined for the card edge printed circuit board 14 between the upper connecting members 33, 33. This insertion opening 34 is connected to an end of the aforementioned passage of the card edge printed circuit board 14. As is apparent from FIG. 5, a pair of guiding surface 34*a*, 34*a*, opposed to each other, may be formed on the insertion opening 34. The guiding surfaces 34*a* are inclined surfaces designed to get closer to each other at a position closer to the passage of the card edge printed circuit board 14.

Figure 6:
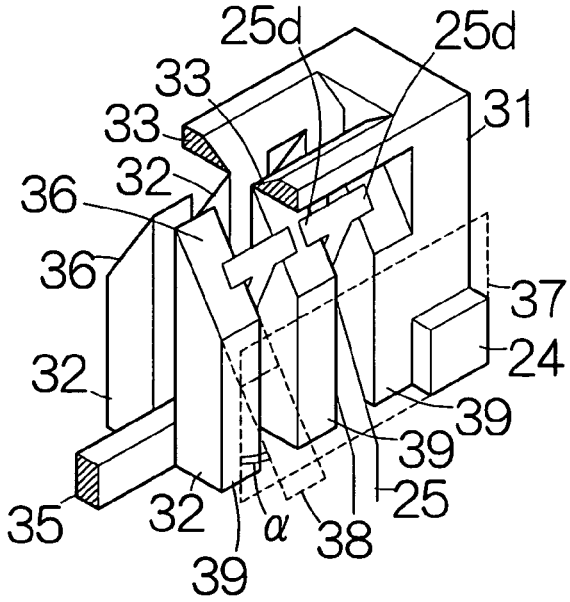
FIG. 6 is a partial cutoff view schematically illustrating the structure of the slider.

As is apparent from FIG. 6, the lower connecting member 35 extends through spaces between the driving pieces 32, 32 of the individual pairs. The driving pieces 32, 32, . . . are integral to the lower connecting member 35, for example. When the card edge printed circuit board 14 is inserted into a space between the driving pieces 32, 32 of the pair, the card edge of the card edge printed circuit board 14 is received on the upper surface of the lower connecting member 35.

An inclined surface 36 is defined on the individual driving piece 32. The inclined surface 36 is opposed to the inner surface of the housing body 17. The inclined surface 36 is designed to extend along an imaginary plane 38 intersecting an imaginary reference plane 37 including the guide surface 22 by an predetermined inclination angle α. The inclined surface 36 thus gets remoter from the passage of the card edge printed circuit board 14 at a location closer to the lower connecting member 35. The tip end of the elastic contact 25 is received on the inclined surface 36. A pair of enlarged pieces 25*d*, 25*d* is formed at the tip end of the elastic contact 25 so as to laterally extend. When the first and second plate pieces 25*a*, 52*b* are inserted between the adjacent driving pieces 32, the enlarged pieces 25*d*, 25*d* are received on the inclined surfaces 36, respectively. The inclined surfaces 36 serve as a converting mechanism as described later in detail.

A vertical surface 39 is connected to the inclined surface 36 in the individual driving piece 32. The vertical surface 39 is connected to the lower end of the inclined surface 36. The lower end corresponds to the end near the lower connecting member 35. The vertical surface may extend along an imaginary plane parallel to the imaginary reference plane 37. The slider 18 may be made of resin material having a higher resistance to abrasion. Molding process may be utilized to form the slider 18 based on the resin material.

Assume that the card connector 14 is withdrawn from the connector 13. The operator pushes down the operating pieces 21*b* of the levers 21 around the rotation axes in directions outward from the slider 18. The driving pieces 21*a* of the lever 21 lift the slider 18 upward. Since the card edge printed circuit board 14 is supported on the lower connecting member 35 of the slider 18, the card edge printed circuit board 14 is forced to move upward along with the slider 18. The guide surfaces 22, 22 serve to guide the upward movement of the slider 18.

The upward movement of the slider 18 induces a relative displacement between the elastic contacts 25 and the slider 18. The enlarged pieces 25*d* of the elastic contacts 25 thus move upward along the inclined surfaces 36. The displacement of the slider 18 allows the individual inclined surface 36 to exhibit a driving force in a direction perpendicular to the imaginary reference plane 37. The driving force acts on the elastic contact 25. The tip ends of the elastic contacts 25 are allowed to climb up the inclined surfaces 36, so that the elastic contacts 25 of the pair get spaced from each other. The bent sections 25*c* of the elastic contacts 25 are in this manner distanced from the contact pads 27 on the card edge printed circuit board 14. The elastic contacts 25 are released from the contact to the card edge printed circuit board 14.

Figure 7:
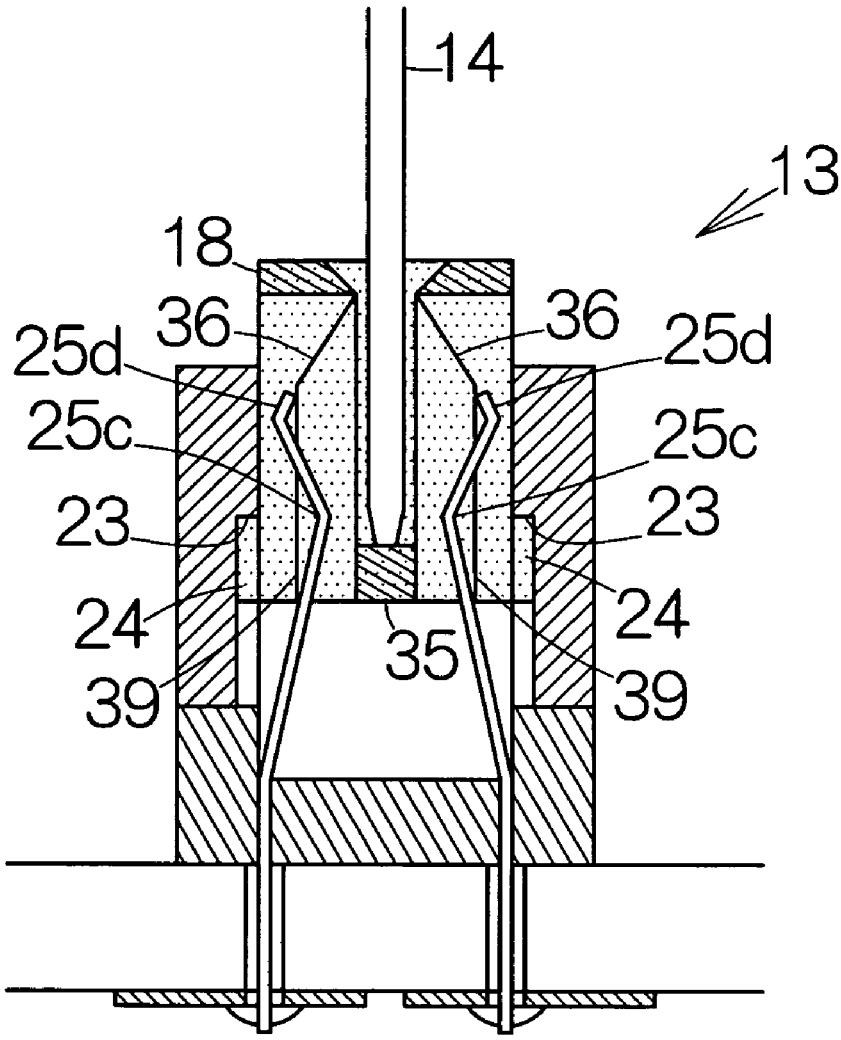
FIG. 7 is a vertical sectional view, corresponding to FIG. 3, schematically illustrating elastic contacts when the slider reaches the uppermost position.

When the operating pieces 21*b* of the levers 21 are further pushed down around the rotation axes, the guide pieces 24 of the slider 18 contact the restriction pieces 23, as shown in FIG. 7, for example. The slider 18 reaches the uppermost position. The enlarged pieces 25*d* of the elastic contacts 25 moves to the vertical surfaces 39 from the inclined surfaces 36. The slider 18 is held between the elastic contacts 25 at the vertical surfaces 39. The elasticity of the elastic contacts 25 serves to hold the slider 18 at the uppermost position. Since the card edge printed circuit board 14 has been released from the contact of the elastic contacts 25, the card edge printed circuit board 14 can easily be withdrawn from the connector 13.

Next, assume that the card edge printed circuit board 14 is to be inserted into the connector 13. The slider 18 is positioned at the uppermost position. When the card edge printed circuit board 14 is inserted into the connector 13, the card edge printed circuit board 14 is received into the slider 18. The card edge printed circuit board 14 slips between the driving pieces 32, 32 of the individual pairs. The card edge of the card edge printed circuit board 14 is received on the lower connecting member 35. When the card edge printed circuit board 14 is further pushed into the connector 13, the movement of the card edge printed circuit board 14 serves to generate a driving force acting on the slider 18. The slider 18 is forced to move downward from the uppermost position toward the lowermost position. The guide surfaces 22, 22 serve to guide the downward movement of the slider 18.

When the slider 18 moves downward in the aforementioned manner, a relative displacement is induced between the elastic contacts 25 and the slider 18 in the direction opposite to the aforementioned relative displacement. The enlarged pieces 25*d* of the elastic contacts 25 move downward along the inclined surfaces 36. The inclined surfaces 36 serve to avoid contact between the elastic contacts 25 and the card edge printed circuit 14 in a predetermined period from the start of the downward movement of the slider 18. In other words, contact is prevented between the elastic contacts 25 and the card edge printed circuit board 14 in an extent of the predetermined distance S from the card edge. The bent sections 25*c* of the elastic contacts 25 are in this manner prevented from contacting the resin material of the card edge printed circuit board 14. Generation of dusts due to abrasion can be prevented.

When the card edge printed circuit board 14 is further pushed down, the elastic contacts 25 of the pairs get closer to each other. The card edge printed circuit board 14 is held between the elastic contacts 25. The bent sections 25*c* of the elastic contacts 25 are urged against the contact pads 27 on the card edge printed circuit board 14. The guide pieces 24 of the slider 18 finally contact the base 16, as shown in FIG. 3, for example. The slider 18 reaches the lowermost position.

The connector 13 allows the elastic contacts 25 to deform in a conventional manner at insertion and withdrawal of the card edge printed circuit board 14. No operations are required in addition to conventional operations. The urging force of the elastic contacts 25 toward the card edge printed circuit board 14 can reliably be relieved without inducing troublesome operations.

The slider 18 can be placed on the base 16 prior to coupling of the housing body 17 to the base 16 in the production process of the connector 13, for example. The elastic contacts 25 may simply contact the inclined surfaces 36 when the slider 18 is placed on the base 16. The assembling can be achieved in a facilitated manner. In addition, the elasticity of the elastic contacts 25 serves to hold the slider 18 on the base 16. Although the slider 18 is not fixed to the base 16, the housing body 17 can be coupled to the base 16 in a facilitated manner. The assembling of the connector 13 can be facilitated. The productivity cannot be deteriorated. It should be noted that any alternative operations may be employed to assemble the connector 13.

An elastic member may be employed to urge the slider 18 toward the uppermost position in the connector 13. The elastic member of the type may be a coil spring, for example. The elastic member may be utilized in place of the levers 21.

What is claimed is:

1. A connector comprising:

a housing;

a slider;

a guide formed on the housing, said guide designed to guide upward and downward movement of the slider along a predetermined plane within the housing;

a passage defined in the slider, said passage receiving a connective member inserted in the housing in parallel with the predetermined plane;

a receiving surface defined on the slider, said receiving surface designed to receive the connective member inserted through the passage so as to cause the downward movement of the slider;

an elastic terminal extending to a free tip end from a stationary end fixed to the housing; and an inclined surface is defined on the slider so as to receive the elastic terminal, the surface being defined between the passage and the elastic terminal, said inclined surface extending along an imaginary plane intersecting an imaginary reference plane including the predetermined plane by a predetermined inclination angle so as to cause the elastic terminal to get closer to the passage in response to the downward movement of the slider based on elasticity of the elastic terminal.

2. A connector comprising:

a housing designed to receive insertion of a connective member along a predetermined imaginary reference plane;

a slider assembled within the housing, said slider designed to move within the housing in parallel with the imaginary reference plane;

a receiving surface formed on the slider, said receiving surface designed to receive the insertion of the connective member so as to cause the movement of the slider based on a driving force applied to the connective member; and an elastic terminal coupled to the housing, said elastic terminal designed to hold the connective member based on elasticity of the elastic terminal itself.

3. The connector according to claim 2, further comprising a driving force generating member connected to the slider, said driving force generating member designed to direct a driving force to the slider in a direction to move the connective member out of the housing.

4. The connector according to claim 2, wherein a converting mechanism is incorporated within the slider, said converting mechanism designed to generate a driving force along an imaginary plane intersecting the imaginary reference plane by a predetermined inclination angle, based on the movement of the slider.

5. The connector according to claim 2, wherein the elastic terminal extends to a free tip end from a stationary end fixed to the housing, and an inclined surface is formed on the slider so as to receive the elastic terminal, said inclined surface extending along an imaginary plane intersecting the imaginary reference plane by a predetermined inclination angle.

6. A connector comprising:

a housing;

a slider;

a guide formed on the housing, said guide designed to guide upward and downward movement of the slider along a predetermined plane within the housing;

a passage defined in the slider, said passage receiving a connective member inserted in the housing in parallel with the predetermined plane;

a receiving surface defined on the slider, said receiving surface designed to receive the connective member inserted through the passage so as to cause the downward movement of the slider;

a pair of elastic terminals each extending to a free tip end from a stationary end fixed to the housing; and a pair of inclined surfaces is defined on the slider so as to receive the pair of elastic terminals, one of the inclined surfaces being defined between the passage and one of the elastic terminals, another of the inclined surfaces being defined between the passage and another of the elastic terminals, wherein each of the inclined surfaces extend along an imaginary plane intersecting an imaginary reference plane including the predetermined plane by a predetermined inclination angle so as to cause the elastic terminals to get closer to each other in response to the downward movement of the slider based on elasticity of the elastic terminals.

* * * * *